US011557838B2

(12) United States Patent
Wang et al.

(10) Patent No.: US 11,557,838 B2
(45) Date of Patent: Jan. 17, 2023

(54) LIQUID CRYSTAL PHASE SHIFTER AND ANTENNA WHERE EFFECTIVE LENGTHS ARE DIFFERENT BETWEEN AN INPUT FEED TERMINAL AND MULTIPLE OUTPUT FEED TERMINALS

(71) Applicant: Chengdu Tianma Micro-Electronics Co., Ltd., Sichuan (CN)

(72) Inventors: Donghua Wang, Chengdu (CN); Bo Wu, Chengdu (CN); Yingru Hu, Chengdu (CN)

(73) Assignee: CHENGDU TIANMA MICRO-ELECTRONICS CO., LTD., Chengdu (CN)

( * ) Notice: Subject to any disclaimer, the term of this patent is extended or adjusted under 35 U.S.C. 154(b) by 228 days.

(21) Appl. No.: 16/959,149

(22) PCT Filed: May 21, 2019

(86) PCT No.: PCT/CN2019/087674
§ 371 (c)(1),
(2) Date: Jun. 30, 2020

(87) PCT Pub. No.: WO2020/015449
PCT Pub. Date: Jan. 23, 2020

(65) Prior Publication Data

US 2020/0343634 A1 Oct. 29, 2020

(30) Foreign Application Priority Data

Jul. 18, 2018 (CN) ..... 201810806844.3

(51) Int. Cl.
*H01Q 3/36* (2006.01)
*H01P 1/18* (2006.01)
(Continued)

(52) U.S. Cl.
CPC ..... *H01Q 3/36* (2013.01); *H01P 1/18* (2013.01); *H01P 1/181* (2013.01); *H01P 1/184* (2013.01); *H01P 3/081* (2013.01); *H01P 5/12* (2013.01)

(58) Field of Classification Search
CPC .. H01P 1/181; H01P 1/184; H01P 1/18; H01P 9/00; H01Q 3/36
(Continued)

(56) References Cited

U.S. PATENT DOCUMENTS

2001/0017577 A1 8/2001 Toko et al.
2014/0022029 A1* 1/2014 Glushchenko et al. ..... H01P 1/184 977/773
2020/0089042 A1* 3/2020 Cao et al. ..... G02F 1/13731

FOREIGN PATENT DOCUMENTS

CN 105308789 A 2/2016
CN 105739211 A 7/2016
(Continued)

*Primary Examiner* — Benny T Lee
(74) *Attorney, Agent, or Firm* — Kilpatrick Townsend & Stockton, LLP

(57) ABSTRACT

Embodiments of the present disclosure provide a liquid crystal phase shifter and an antenna, which relate to the field of electromagnetic waves and can adjust carrier frequencies applicable to the liquid crystal phase shifter, improving compatibility of the liquid crystal phase shifter. The liquid crystal phase shifter includes at least one phase-shifting unit. The phase-shifting unit includes a microstrip line and a phase-controlled electrode, the microstrip line includes a plurality of sub-microstrip lines, each sub-microstrip line includes two ends and a transmission portion connected between the two ends, and any two adjacent sub-microstrip lines share one end. The phase-shifting unit further includes feed terminals located on a side of the first substrate facing away from the second substrate or on a side of the second
(Continued)

substrate facing away from the first substrate, and each of the feed terminals overlaps the corresponding end respectively.

18 Claims, 6 Drawing Sheets

(51) Int. Cl.
*H01P 3/08* (2006.01)
*H01P 5/12* (2006.01)

(58) Field of Classification Search
USPC ..... 333/161
See application file for complete search history.

(56) References Cited

FOREIGN PATENT DOCUMENTS

| | | | |
|---|---|---|---|
| CN | 105896082 | A | 8/2016 |
| CN | 205488558 | U | 8/2016 |
| CN | 106125417 | A | 11/2016 |
| CN | 106532200 | A | 3/2017 |
| CN | 106773338 | A | 5/2017 |
| CN | 106940502 | A | 7/2017 |
| CN | 107994302 | A | 5/2018 |
| CN | 108181745 | A | 6/2018 |
| CN | 108615962 | A | 10/2018 |

* cited by examiner

LIQUID CRYSTAL PHASE SHIFTER AND ANTENNA WHERE EFFECTIVE LENGTHS ARE DIFFERENT BETWEEN AN INPUT FEED TERMINAL AND MULTIPLE OUTPUT FEED TERMINALS

CROSS-REFERENCE TO RELATED APPLICATIONS

This application is based on International Application No. PCT/CN2019/087674 filed on May 21, 2019, which claims priority to Chinese Patent Application No. 201810806844.3, filed on Jul. 18, 2018 and titled with "LIQUID CRYSTAL PHASE SHIFTER AND ANTENNA", the content of which is incorporated herein by reference in their entireties.

FIELD

The present disclosure relates to the field of electromagnetic wave, and in particular, to a liquid crystal phase shifter and an antenna.

BACKGROUND

A phase shifter is a device that can adjust a phase of an electromagnetic wave, and such a phase shifter is widely used in the fields such as radars, spacecraft attitude control, accelerators, communication, instruments, and even in the music field.

New liquid crystal phase shifters have been emerging with the advance in technology. However, in current designs of liquid crystal phase shifter, carrier frequencies of the liquid crystal phase shifter are fixed and can only be adjusted by creating a new liquid crystal phase shifter. That is, the liquid crystal phase shifters have relatively poor compatibility.

SUMMARY OF THE DISCLOSURE

Embodiments of the present disclosure provide a liquid crystal phase shifter and an antenna, which can adjust carrier frequencies applicable to the liquid crystal phase shifter, thereby improving the compatibility of the liquid crystal phase shifter.

In one aspect, an embodiment of the present disclosure provides a liquid crystal phase shifter, including: a first substrate and a second substrate opposite to each other; a liquid crystal layer between the first substrate and the second substrate; and at least one phase-shifting unit. Each of the at least one phase-shifting unit comprises a microstrip line and a phase-controlled electrode, the microstrip line is located between the first substrate and the liquid crystal layer, the phase-controlled electrode is located between the second substrate and the liquid crystal layer, the microstrip line comprises a plurality of sub-microstrip lines, each of the sub-microstrip lines comprises a transmission portion having two ends, and one end of the two ends of one sub-microstrip line of any two adjacent sub-microstrip lines of the plurality of sub-microstrip lines is the same as one end of the two ends of another one sub-microstrip line of the any two adjacent sub-microstrip lines. The phase-shifting unit further includes feed terminals each corresponding to one of the ends, the feed terminals are located on a side of the first substrate facing away from the second substrate or on a side of the second substrate facing away from the first substrate, and in a direction perpendicular to a plane of the first substrate, each of the feed terminals overlaps a corresponding one of the two ends.

In another aspect, an embodiment of the present disclosure further provides an antenna including a liquid crystal phase shifter. The liquid crystal phase shifter includes a first substrate and a second substrate opposite to each other; a liquid crystal layer between the first substrate and the second substrate; and at least one phase-shifting unit. Each of the at least one phase-shifting unit comprises a microstrip line and a phase-controlled electrode, the microstrip line is located between the first substrate and the liquid crystal layer, the phase-controlled electrode is located between the second substrate and the liquid crystal layer, the microstrip line comprises a plurality of sub-microstrip lines, each of the sub-microstrip lines comprises a transmission portion having two ends, and one end of the two ends of one sub-microstrip line of any two adjacent sub-microstrip lines of the plurality of sub-microstrip lines is the same as one end of the two ends of another one sub-microstrip line of the any two adjacent sub-microstrip lines. The phase-shifting unit further includes feed terminals each corresponding to one of the ends, the feed terminals are located on a side of the first substrate facing away from the second substrate or on a side of the second substrate facing away from the first substrate, and in a direction perpendicular to a plane of the first substrate, each of the feed terminals overlaps a corresponding one of the two ends.

BRIEF DESCRIPTION OF DRAWINGS

In order to explain technical solutions of embodiments of the present disclosure, the accompanying drawings used in the embodiments are briefly described below. The drawings merely illustrate a part of the embodiments of the present disclosure. Based on these drawings, those skilled in the art can obtain other drawings without any creative efforts.

DETAILED DESCRIPTION OF THE EMBODIMENTS

In order to explain the technical solutions of the present disclosure, the embodiments of the present disclosure are described in details with reference to the drawings, where like features are denoted by the same reference label throughout the drawings and throughout the specification description. It should be understood that the described embodiments are merely parts of, rather than all of the embodiments of the present disclosure. Any other embodiments obtained by those skilled in the art without paying creative labor shall fall into the protection scope of the present disclosure.

The terms used in the embodiments of the present disclosure are merely for the purpose of describing particular embodiments, but are not intended to limit the present disclosure. Unless otherwise noted in the context, the singular form expressions "a", "an", "the" and "said" used in the embodiments and appended claims of the present disclosure are also intended to indicate a plural form.

Figure 1:
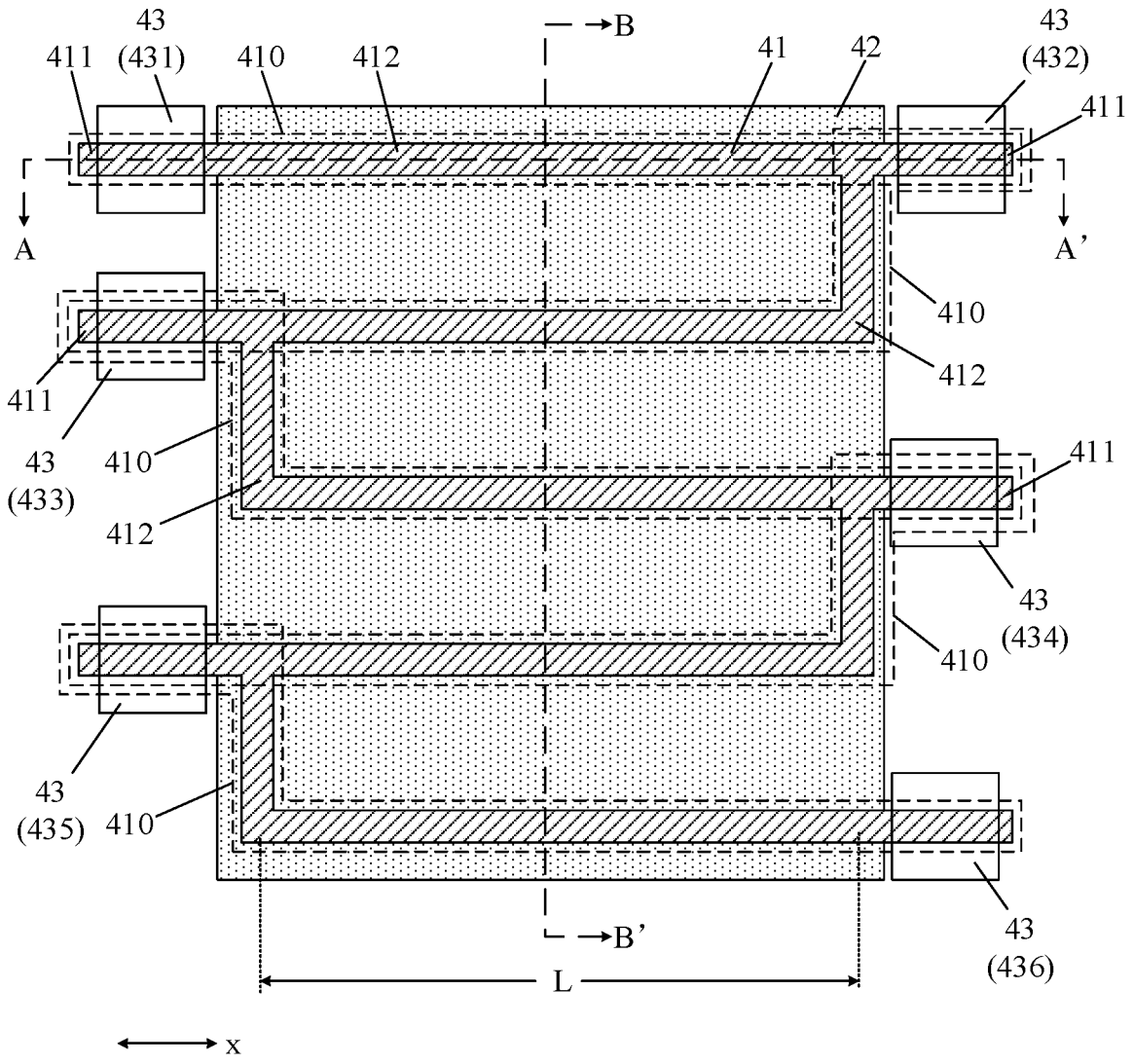
FIG. 1 is a top view of a liquid crystal phase shifter according to an embodiment of the present disclosure.
Figure 2:
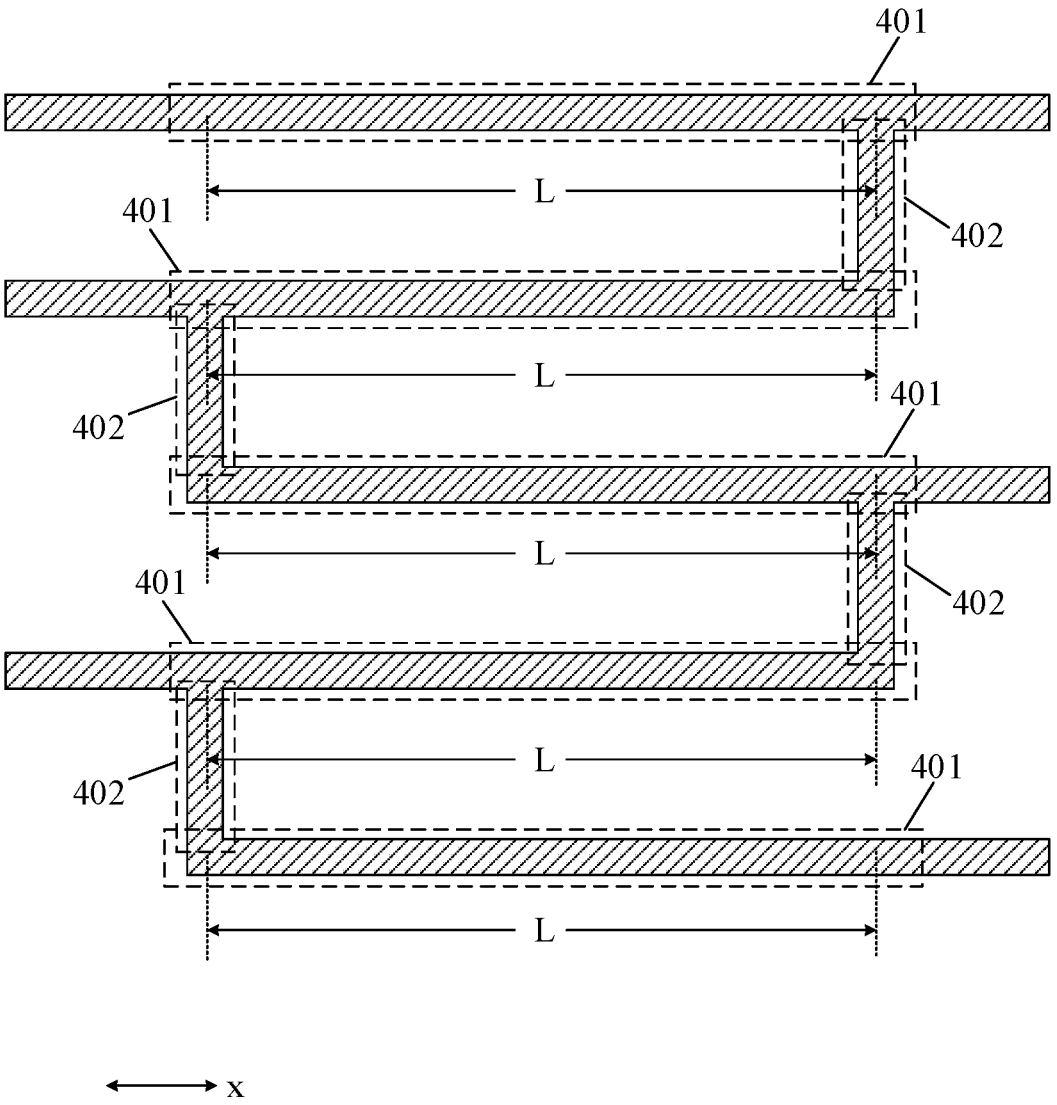
FIG. 2 is a structural schematic diagram of a microstrip line in FIG. 1.
Figure 3:
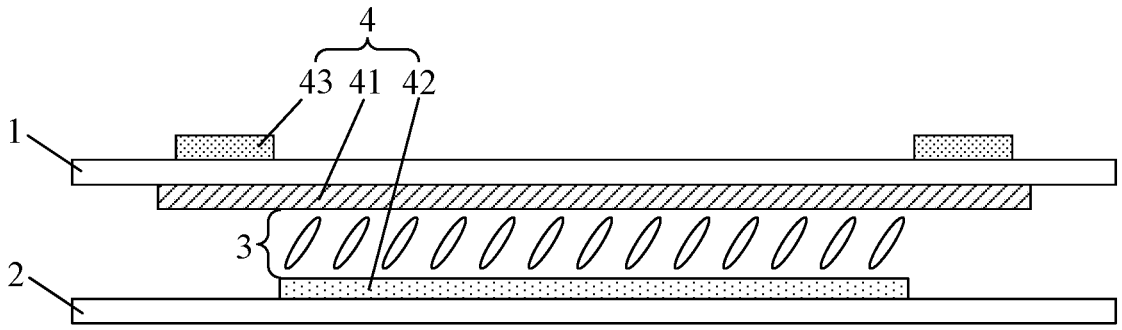
FIG. 3 is a cross-sectional view taken along an AA' direction in FIG. 1.
Figure 4:
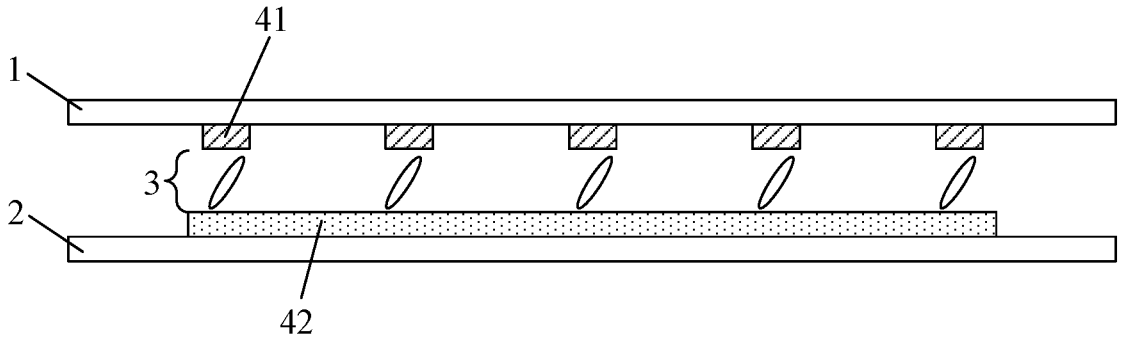
FIG. 4 is a cross-sectional view taken along a BB' direction in FIG. 1.

FIG. 1 is a top view of a liquid crystal phase shifter according to an embodiment of the present disclosure, FIG. 2 is a structural schematic diagram of a microstrip line in FIG. 1, FIG. 3 is a cross-sectional view along an AA' direction in FIG. 1, and FIG. 4 is a cross-sectional view along a BB' direction in FIG. 1. As shown in FIG. 1, FIG. 2, FIG. 3 and FIG. 4, the embodiment of the present disclosure provides a liquid crystal phase shifter, and the liquid crystal phase shifter includes: a first substrate 1, a second substrate 2 disposed opposite to the first substrate 1, a liquid crystal layer 3 located between the first substrate 1 and the second substrate 2, as shown in FIGS. 1, 3 and 4; and at least one phase-shifting unit 4 (FIG. 4). Each phase-shifting unit 4 includes a microstrip line 41 and a phase-controlled electrode 42, as shown in FIGS. 1, 3 and 4. The microstrip line 41 is located between the first substrate 1 and the liquid crystal layer 3, and the phase-controlled electrode 42 is located between the second substrate 2 and the liquid crystal layer 3. The microstrip line 41 includes a plurality of sub-microstrip lines 410, as shown in FIG. 1. Each sub-microstrip line 410 includes two ends 411 and a transmission portion 412 connected between the two ends 411 as shown in FIG. 1. Any two adjacent sub-microstrip lines 410 share one of the two ends 411. The phase-shifting unit 4 further includes feed terminals 43 (FIGS. 1 and 3) respectively corresponding to the ends 411. The feed terminals 43 are located on a side of the first substrate 1 facing away from the second substrate 2 or on a side of the second substrate 2 facing away from the first substrate 1. FIGS. 1 to 3 only illustrate that the feed terminals 43 are located on the side of the first substrate 1 facing away from the second substrate 2, and in a direction perpendicular to a plane of the first substrate 1, each of the feed terminals 43 overlaps the corresponding end 411.

Specifically, during the operation of the liquid crystal phase shifter, a voltage signal is applied to the microstrip line 41 and the phase-controlled electrode 42 to form an electric field between the microstrip line 41 and the phase-controlled electrode 42, and the electric field drives the liquid crystals in the liquid crystal layer 3 to be deflected. The microstrip line 41 is configured to transmit a microwave signal between the microstrip line 41 and the phase-controlled electrode 42. During the transmission of the microwave signal, a phase changes with the deflection of the liquid crystals, achieving a phase-shifting function of the microwave signal. The phase-shifting of the microwave is a change of electrical characteristics of the deflected liquid crystals, and a carrier frequency applicable to the phase-shifting unit is related to a distance transmitted by the microwave in the deflected liquid crystals. In the embodiment of the present disclosure, the transmission portion 412 is configured to transmit the microwave signal and perform the phase-shifting during the transmission process, and the feed terminal 43 is configured to input and output the microwave signal on the microstrip line 41 by cooperating with the ends of the microstrip line 41. In the embodiment of the present disclosure, the microstrip line 41 includes at least two sub-microstrip lines 410. Each of the two sub-microstrip lines 410 includes two ends 411 and a transmission portion 412 connected between the two ends 411, and each of the two ends 411 can be correspondingly provided with one feed terminal 43. The microstrip line 41 includes at least three feed terminals 43. When the liquid crystal phase shifter operates, any two of the at least three feed terminals 43 can be used as an actual input feed terminal and an actual output feed terminal respectively. When selecting to use different feed terminals 43, transmission distances of the microwave transmitted on the microstrip line 41 are different, which results in different effective path lengths of the phase-shifting of the microwave caused by the deflected liquid crystals during the microwave transmission. That is, the liquid crystal phase shifter can be adapted to different carrier frequencies. For example, the liquid crystal phase shifter shown in FIG. 1 includes five sub-microstrip lines 410 and six feed terminals 43. The six feed terminals 43 include a first feed terminal 431, a second feed terminal 432, a third feed terminal 433, a fourth feed terminal 434, a fifth feed terminal 435, and a sixth feed terminal 436. When the first feed terminal 431 and the second feed terminal 432 are selected as the actual input feed terminal and the actual output feed terminal respectively, the transmission distance of the microwave on the microstrip line 41 is relatively short; and when the first feed terminal 431 and the third feed terminal 433 are selected as the actual input feed terminal and the actual output feed terminal respectively, the microwave transmission distance of the microstrip line 41 is relatively long.

In the liquid crystal phase shifter according to the embodiment of the present disclosure, the microstrip lines of the liquid crystal phase shifter correspond to at least three feed terminals. When the liquid crystal phase shifter operates, any two of the at least three feed terminals can be selected as an actual input feed terminal and an actual output feed terminal. When using different feed terminals, the transmission distances of the microwave on the microstrip lines are different, which results in different effective path lengths of the phase-shifting of the microwave caused by the deflected liquid crystals during the microwave transmission. That is, the liquid crystal phase shifter can be adapted to different carrier frequencies. However, in the related art, the microstrip lines of the liquid crystal phase shifter only correspond to two feed terminals, and the applicable carrier frequency cannot be adjusted. Therefore, the embodiments of the present disclosure improve the compatibility of the liquid crystal phase shifter.

Figure 5:
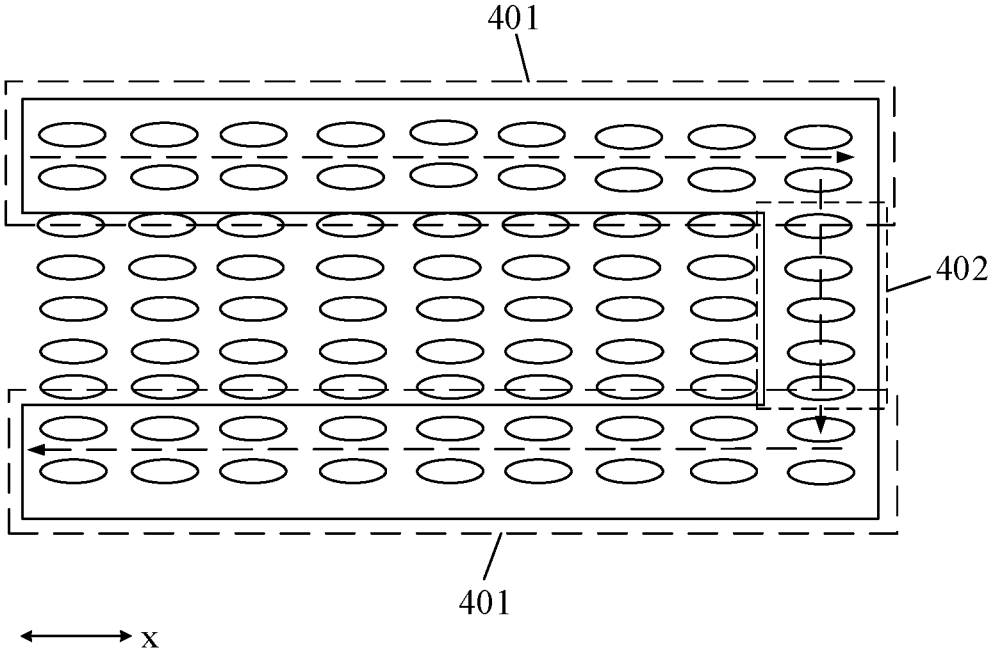
FIG. 5 is a schematic diagram of an arrangement of liquid crystals in some regions in a non-operating state of the liquid crystal phase shifter shown in FIG. 2.
Figure 6:
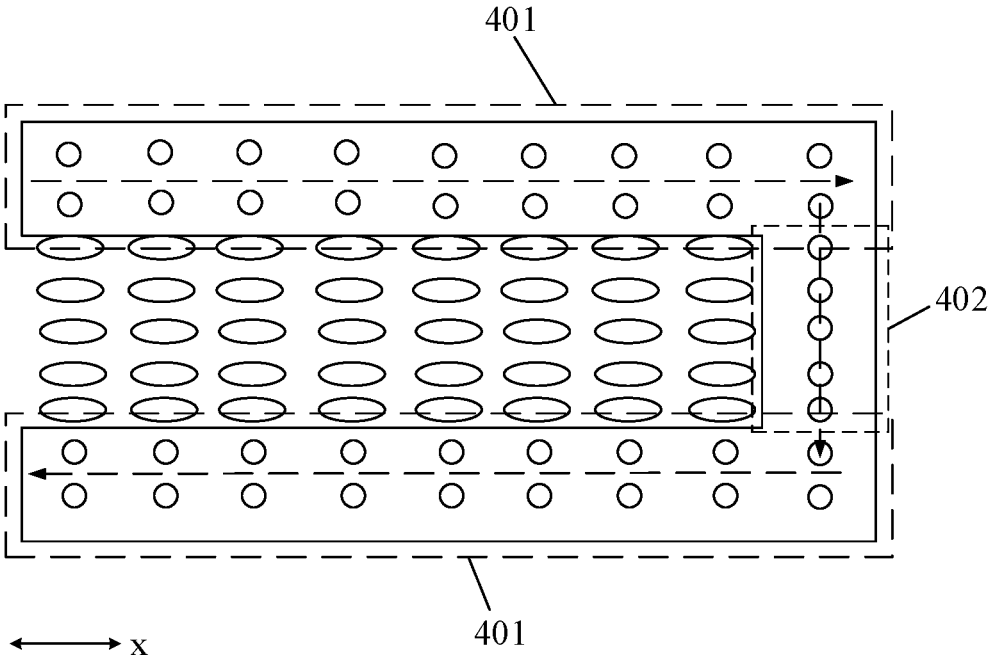
FIG. 6 is a schematic diagram of an arrangement of liquid crystals in some regions in an operating state of the liquid crystal phase shifter shown in FIG. 2.

In one embodiment, as shown in FIG. 1, FIG. 2, FIG. 3, FIG. 4, FIG. 5, and FIG. 6, FIG. 5 is a schematic diagram of an arrangement of liquid crystals in some regions in a non-operating state of the liquid crystal phase shifter shown in FIG. 2, FIG. 6 is a schematic diagram of an arrangement of liquid crystals in some regions in an operating state of the liquid crystal phase shifter shown in FIG. 2, and each transmission portion 412 (FIG. 1) includes an effective segment 401 extending along an initial alignment direction x of the liquid crystal layer (as shown in FIGS. 2 and 5); at least one transmission portion 412 includes a non-effective segment 402 extending along a direction other than the initial alignment direction of the liquid crystal layer; two effective segments 401 respectively located on any two adjacent transmission portions 412 are connected by the non-effective segment 402 (as shown in FIGS. 2 and 5).

Specifically, in an example of positive liquid crystal molecules, in the non-operating state, no electric field is formed between the phase-controlled electrode 42 and the microstrip line 41 in the liquid crystal phase shifter, and long axes of the liquid crystal molecules in the liquid crystal layer 3 extend and are arranged along the initial alignment direction x of the liquid crystal layer. In the operating state, the electric field is formed between the phase-controlled electrode 42 and the microstrip line 41 in the liquid crystal phase shifter, the liquid crystals between the phase-controlled electrode 42 and the microstrip line 41 are deflected, and the microwave transmitted along the extending path of the microstrip line 41 is phase-shifted due to the change in the electrical characteristics of the deflected liquid crystal. The transmission paths of the microwave are represented by the dotted arrows in FIG. 4 and FIG. 5. On the microwave transmission path corresponding to the effective segment 401, the liquid crystals, before being deflected, correspond to dielectric properties of the long axes of the liquid crystal molecules, while the deflected liquid crystals correspond to dielectric properties of short axes of the liquid crystal molecules. Therefore, in the operating state of the liquid crystal phase shifter, the effective segment 401 correspond to the effective path of the phase-shifting of the microwave, to exert a liquid crystal phase-shifting function, while in the non-operating state, the liquid crystal phase shifter is unable to exert the liquid crystal phase-shifting function. On the microwave transmission path corresponding to the non-effective segment 402, the liquid crystals, before and after being deflected, always correspond to the dielectric properties of the short axes of the liquid crystal molecules. In this case, when the liquid crystal phase shifter is in the operating state, the non-effective segment 402 corresponds to the non-effective path of the phase-shifting of the microwave, failing to exert the liquid crystal phase-shifting function, and the liquid crystal phase shifter also cannot exert the liquid crystal phase-shifting function in the non-operating state. By respectively providing the effective segment 401 extending along the initial alignment direction x of the liquid crystal layer and the non-effective segment 402 extending along the direction other than the initial alignment direction of the liquid crystal layer, a shape of the overall microstrip line 41 can be designed in a more flexible manner, to effectively utilize the space.

It should be noted that the initial alignment direction x of the liquid crystal layer is not limited to that shown in the drawings, and other directions are also possible, as long as the effective segment 401 dominates the adjustment of the phase of the microwave signal. The initial alignment direction x of the liquid crystal layer can be set by the liquid crystal orientation layer. For example, as shown in FIGS. 3 and 4, a liquid crystal orientation layer is provided between the liquid crystal layer 3 and the microstrip line 41, and a liquid crystal orientation layer is provided between the liquid crystal layer 3 and the phase-controlled electrode 42. When the liquid crystal phase shifter is in the non-operating state, the long axes of the liquid crystal molecules in the liquid crystal layer 3 extend along the initial alignment direction x of the liquid crystal layer under the action of the liquid crystal orientation layer. It can be understood that in the embodiments of the present disclosure, the liquid crystal molecules can also be negative liquid crystal molecules, and the liquid crystal molecules in the present disclosure are not limited a specific type.

In one embodiment, each effective segment 401 has the same length, and thus multiples of the effective path length of the microwave phase-shifting can be selected by selecting different feed terminals 43. For example, the length of each effective segment 401 is L, as shown in FIGS. 1 and 2, and when the first feed terminal 431 and the second feed terminal 432 are selected as the actual input feed terminal and the actual output feed terminal, the effective path length of the microwave phase-shifting is L; when the first feed terminal 431 and the third feed terminal 433 are selected as the actual input feed terminal and the actual output feed terminal, the effective path length of the microwave phase-shifting is 2 L; and so on. When the respective effective segments 401 have the same length, the effective path length can be simply adjusted in multiples by switching of the different feeding terminals 43.

In one embodiment, the non-effective segments 402 extend in the same direction, which can form a serpentine transmission portion 412 and utilizes the space more efficiently.

In one embodiment, the extending direction of each non-effective segment 402 is perpendicular to the initial alignment direction x of the liquid crystal layer, so as to ensure that the deflection of the liquid crystals corresponding to the non-effective segment 402 will not cause the liquid crystal phase-shifting. In this way, the effective path length of the phase-shifting of the microwave can be more accurately adjusted.

In one embodiment, a U-shaped structure is formed by any two adjacent effective segments 401 and the non-effective segment 402 that connects the two adjacent effective segments 401.

Figure 7:
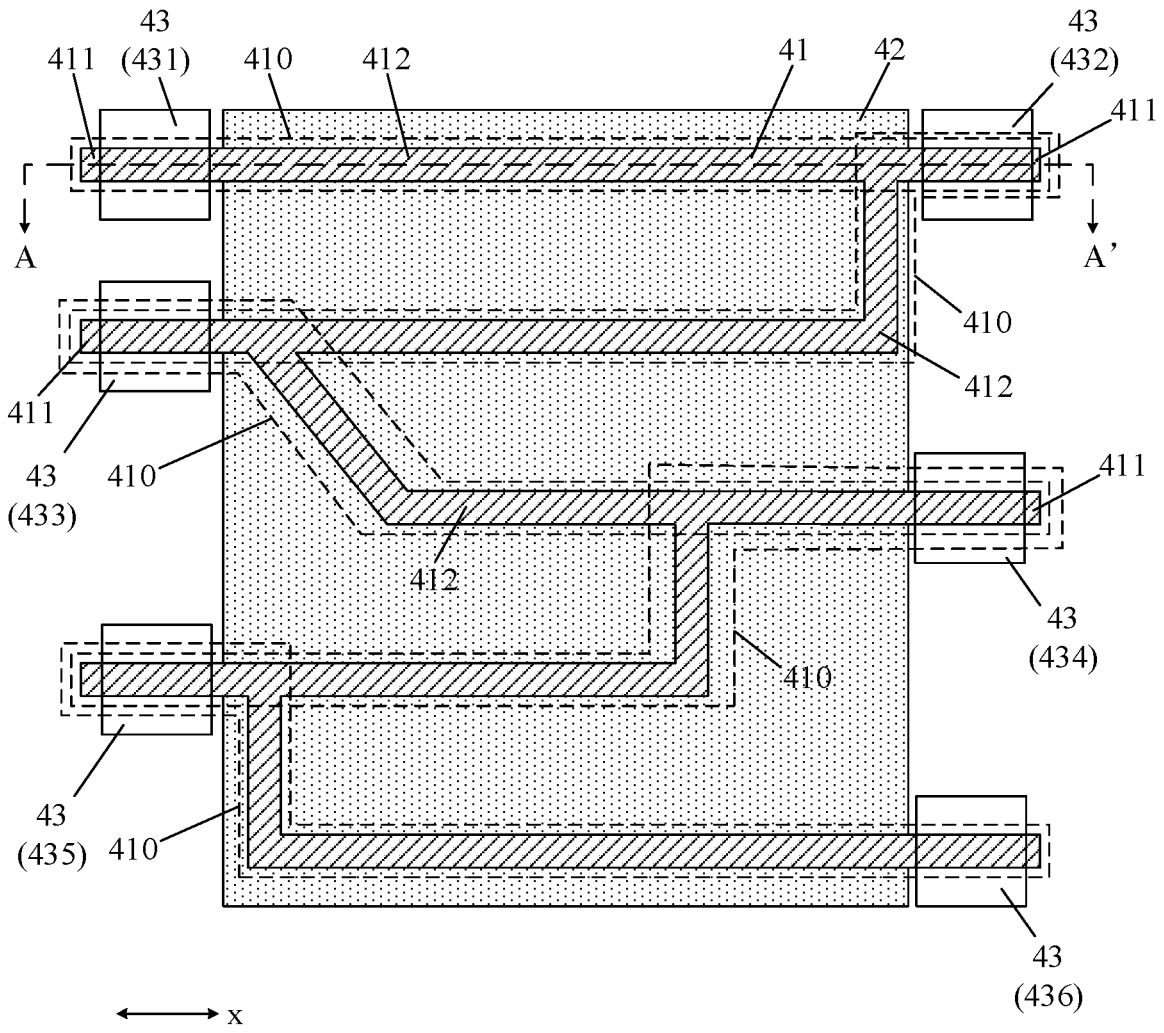
FIG. 7 is a top view of a liquid crystal phase shifter according to another embodiment of the present disclosure.
Figure 8:
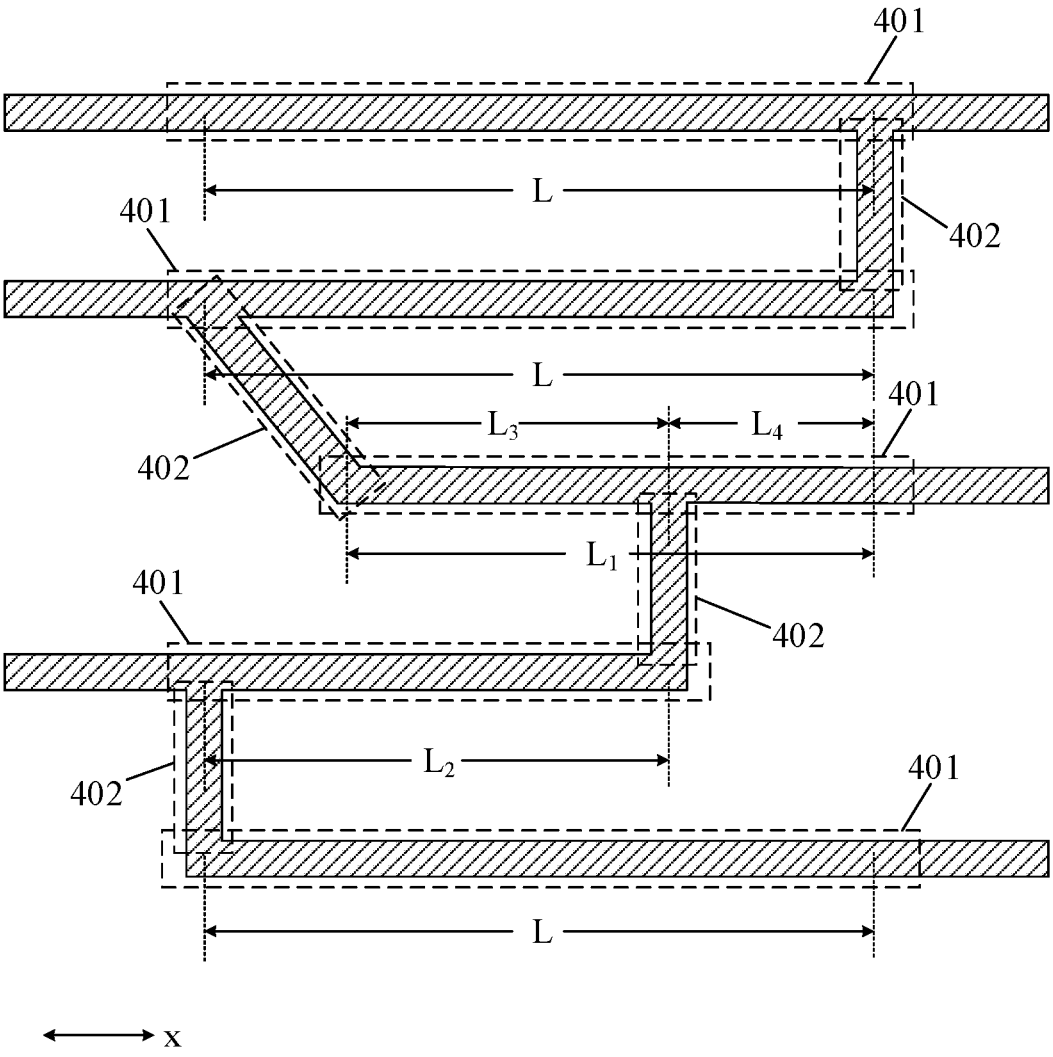
FIG. 8 is a structural schematic diagram of a microstrip line in FIG. 7.

In one embodiment, FIG. 7 is a top view of a liquid crystal phase shifter according to another embodiment of the present disclosure, FIG. 8 is a structural schematic diagram of a microstrip line in FIG. 7. As shown in FIG. 7 and FIG. 8, at least one effective segment 401 has a length different from that of other effective segments 401, as shown in FIG. 8.

Specifically, in the structure of the liquid crystal phase shifter shown in FIG. 7 and FIG. 8, not all of the respective effective segments 401 in the microstrip line 41 (FIG. 7) have the same length. For example, as shown in FIG. 8, from top to bottom, the lengths of the first, second, and fifth effective segments 401 are L, the length of the third effective segment 401 is L1, the length of the fourth effective segment is L2, and when the first feed terminal 431 and the second feed terminal 432, as shown in FIG. 7, are selected as the actual input feed terminal and the actual output feed terminal, the effective path length of microwave phase-shifting is L; when the first feed terminal 431 and the fourth feed terminal 434 (FIG. 7) are selected as the actual input feed terminal and the actual output feed terminal, the effective path length of microwave phase-shifting is a sum of 2 L and L1. Since the lengths of the respective effective segments 401 are unnecessarily to be equal, the effective path length of the microwave phase-shifting can be adjusted in a more flexible manner by the switching of the different feed terminal 43 as shown in FIG. 7.

In one embodiment, as shown FIG. 8, the extending direction of at least one non-effective segment 402 is not perpendicular to the initial alignment direction x of the liquid crystal layer, such that the effective segments 401 can have different lengths.

In one embodiment, as shown FIG. 8, the extending direction of at least one non-effective segment 402 is perpendicular to the initial alignment direction x of the liquid crystal layer, such that some of the effective segments 401 can have the same length.

In one embodiment, as shown FIG. 8, a T-shaped structure is formed by at least one effective segment 401 and a non-effective segment 402 connected thereto.

For example, as shown in FIG. 8, a T-shaped structure is formed by the third effective segment 401 from top to bottom and the non-effective segment 402 therebelow. In the T-shaped structure, a part of the effective segment 401 on a left side of the non-effective segment 402 has a length of L3, and a part of the effective segment 401 on a right side of the non-effective segment 402 has a length of L4, where L1=L3+L4. In such a structure, the effective path of the microwave phase-shifting can be adjusted in a more flexible manner. For example, when the third feed terminal 433 (FIG. 7) and the fourth feed terminal 434 (FIG. 7) are selected as the actual input feed terminal and the actual output feed terminal, the effective path length of microwave phase-shifting is L+L1=L+L2+L3; when the third feed terminal 433 and the fifth feed terminal 435 (FIG. 7) are selected as the actual input feed terminal and the actual output feed terminal, the effective path length of microwave phase-shifting is L3+L2; and when the fourth feed terminal 434 and the fifth feed terminal 435 are selected as the actual input feed terminal and the actual output feed terminal, the effective path length of microwave phase-shifting is L4+L2.

In one embodiment, as shown in FIG. 7, the feed terminals 43 includes one input feed terminal and at least two output feed terminals, and each effective length of the microstrip line 41 from the input feed terminal to any one of the output feed terminals is different from one another, so that the effective path length of the microwave phase-shifting can be adjusted merely by selecting the actual output feed terminal from the multiple output feed terminals. Thus, the adjustment method is relatively simple. Alternatively, the feed terminals 43 includes one output feed terminal and at least two input feed terminals, and each effective length of the microstrip line 41 from the output feed terminal to any one of the input feed terminals is different from one another, such that the effective path length of the microwave phase-shifting can be adjusted, and the adjustment method is relatively simple.

In one embodiment, as shown in FIGS. 2 and 7, the phase-controlled electrode 42 covers the transmission portion 412 of the microstrip line 41 in the direction perpendicular to the plane of the first substrate.

Specifically, during the operation of the liquid crystal phase shifter, only the liquid crystals corresponding to the part of the microstrip line 41 covered by the phase-controlled electrode 42 will be deflected, so as to exert the liquid crystal phase shift function at a position corresponding to the effective segment 401. Theoretically, the non-effective segment 402 of the transmission portion 412 is unnecessarily covered by the phase-controlled electrode 42. However, the phase-controlled electrode 42 may cover the entire transmission portion 412 in order to reduce process difficulty of the phase-controlled electrode 42. In addition, it should be noted that in the structure shown in FIG. 3, the feed terminal 43 is located on the side of the first substrate 1 facing away from the second substrate 2. In this case, the feed terminal 43 can directly input and output the microwave signals between the feed terminal 43 and the microstrip line 41, and the phase-controlled electrode 42 can cover the entire microstrip line 41 and may also cover the transmission portion 412 to expose the feed terminal 43. In addition, in other implementable embodiments, if the feed terminal is located on the side of the second substrate facing away from the first substrate, since the phase-controlled electrode is located between the microstrip line and the feed terminal, the phase-controlled electrode is required to have a hollow structure at the position of the feed terminal, in order to avoid an adverse effect of the phase-controlled electrode on the inputting and outputting of the microwave signals on the microstrip line.

It should be noted that, in the liquid crystal phase shifter in the embodiment of the present disclosure, only one phase-shifting unit 4 is illustrated. In other implementable embodiments, one liquid crystal phase shifter includes a plurality of phase-shifting units distributed in an array, and the phase-controlled electrodes of the plurality of phase-shifting units are connected to each other in such a manner that all the phase-controlled electrodes have the same potential. Each phase-shifting unit is configured to exert the phase-shifting function of one microwave signal. Each phase-shifting unit can be fabricated as a different liquid crystal cell, and it is also possible to fabricate all the phase-shifting units into the same one liquid crystal cell. In addition, in the embodiment of the present disclosure, the feed terminal 43 may be a part of the feeder, and the feeder is configured to transmit the microwave signal between the feed terminal 43 and other components. For example, in an application scenario of an antenna, a radiating unit of the antenna is connected to the feed terminal 43 through the feeder, after the liquid crystal phase shifter completes the phase-shifting, the microwave signal is fed from the microstrip line 41 to the feed terminal 43, the feed terminal 43 transmits the phase-shifted microwave signal to the radiating unit through the feeder, and the radiating unit radiates the microwave signal to exert an antenna function.

An embodiment of the present disclosure further provides an antenna including the above liquid crystal phase shifter. The liquid crystal phase shifter is configured to exert the phase-shifting function of the microwave signal in the antenna.

The specific structure and principle of the liquid crystal phase shifter are the same as those in the above embodiment, which will not be repeated herein.

In the antenna according to the embodiment of the present disclosure, the microstrip line of the liquid crystal phase shifter corresponds to at least three feed terminals. When the liquid crystal phase shifter operates, any two of the at least three feed terminals can be selected as an actual input feed terminal and an actual output feed terminal. When using different feed terminals, the microstrip lines have different microwave transmission distances. When the microwave transmission distances are different, the effective path lengths of the phase-shifting of the microwave by the deflected liquid crystal can be different during microwave transmission. That is, the liquid crystal phase shifter can be adapted to different carrier frequencies. However, in the related art, the microstrip line of the liquid crystal phase shifter only corresponds to two feed terminals, and the applicable carrier frequency cannot be adjusted. Therefore, the embodiments of the present disclosure improve the compatibility of the liquid crystal phase shifter.

What is claimed is:

1. A liquid crystal phase shifter, comprising:

a first substrate and a second substrate that are opposite to each other;

a liquid crystal layer disposed between the first substrate and the second substrate; and at least one phase-shifting unit, wherein each of the at least one phase-shifting unit comprises a microstrip line and a phase-controlled electrode, the microstrip line is located between the first substrate and the liquid crystal layer, the phase-controlled electrode is located between the second substrate and the liquid crystal layer, the microstrip line comprises a plurality of sub-microstrip lines, each of the sub-microstrip lines comprises a transmission portion having two ends, and one end of the two ends of one sub-microstrip line of any two adjacent sub-microstrip lines of the plurality of sub-microstrip lines is the same as one end of the two ends of another one sub-microstrip line of the any two adjacent sub-microstrip lines, the phase-shifting unit further comprises feed terminals respectively corresponding to each of the two ends of the sub-microstrip lines, the feed terminals are located on a side of the first substrate facing away from the second substrate or on a side of the second substrate facing away from the first substrate, and in a direction perpendicular to a plane of the first substrate, each of the feed terminals overlaps a corresponding one of the two ends of the sub-microstrip lines, and the feed terminals comprise one input feed terminal and at least two output feed terminals, and an effective length of the microstrip line from the one input feed terminal to one of the at least two output feed terminals is different from an effective length of the microstrip line from the one input feed terminal to another one of the at least two output feed terminals; or the feed terminals comprise one output feed terminal and at least two input feed terminals, and an effective length of the microstrip line from the one output feed terminal to one of the at least two input feed terminals is different from an effective length of the microstrip line from the one output feed terminal to another one of the at least two input feed terminals.

2. The liquid crystal phase shifter according to claim 1, wherein each of the transmission portions comprises an effective segment extending along an initial alignment direction of the liquid crystal layer, at least one transmission portion of the transmission portions comprises a non-effective segment extending in a direction other than the initial alignment direction of the liquid crystal layer, and two effective segments of any two adjacent transmission portions of the transmission portions are connected by the non-effective segment of one of the at least one transmission portion.

3. The liquid crystal phase shifter according to claim 2, wherein the effective segments of the transmission portions have an equal length.

4. The liquid crystal phase shifter according to claim 3, wherein extending directions of the non-effective segments of the at least one transmission portion are the same.

5. The liquid crystal phase shifter according to claim 4, wherein the extending direction of each of the non-effective segments is perpendicular to the initial alignment direction of the liquid crystal layer.

6. The liquid crystal phase shifter according to claim 5, wherein a U-shaped structure is formed by any two adjacent effective segments and a non-effective segment connecting the two adjacent effective segments.

7. The liquid crystal phase shifter according to claim 2, wherein at least one of the two effective segments has a length different from the remaining ones of the two effective segments.

8. The liquid crystal phase shifter according to claim 7, wherein an extending direction of at least one of the non-effective segments is not perpendicular to the initial alignment direction of the liquid crystal layer.

9. The liquid crystal phase shifter according to claim 8, wherein an extending direction of at least another one of the non-effective segments of the at least one transmission portion is perpendicular to the initial alignment direction of the liquid crystal layer.

10. The liquid crystal phase shifter according to claim 7, wherein a T-shaped structure is formed by at least one of the two effective segments and a non-effective segment connected thereto.

11. The liquid crystal phase shifter according to claim 1, wherein in the direction perpendicular to the plane of the first substrate, the phase-controlled electrode covers the transmission portion of the sub-microstrip lines.

12. An antenna, comprising a liquid crystal phase shifter, the liquid crystal phase shifter comprising:

a first substrate and a second substrate that are opposite to each other;

a liquid crystal layer disposed between the first substrate and the second substrate; and at least one phase-shifting unit, wherein each of the at least one phase-shifting unit comprises a microstrip line and a phase-controlled electrode, the microstrip line is located between the first substrate and the liquid crystal layer, the phase-controlled electrode is located between the second substrate and the liquid crystal layer, the microstrip line comprises a plurality of sub-microstrip lines, each of the sub-microstrip lines comprises a transmission portion having two ends, and one end of the two ends of one sub-microstrip line of any two adjacent sub-microstrip lines of the plurality of sub-microstrip lines is the same as one end of the two ends of another one sub-microstrip line of the any two adjacent sub-microstrip lines, the phase-shifting unit further comprises feed terminals respectively corresponding to each of the two ends of the sub-microstrip lines, feed terminals are located on a side of the first substrate facing away from the second substrate or on a side of the second substrate facing away from the first substrate, and in a direction perpendicular to a plane of the first substrate, each of the feed terminals overlaps a corresponding one of the two ends of the sub-microstrip lines, and the feed terminals comprise one input feed terminal and at least two output feed terminals, and an effective length of the microstrip line from the one input feed terminal to one of the at least two output feed terminals is different from an effective length of the microstrip line from the one input feed terminal to another one of the at least two output feed terminals; or the feed terminals comprise one output feed terminal and at least two input feed terminals, and an effective length of the microstrip line from the one output feed terminal to one of the at least two input feed terminals is different from an effective length of the microstrip line from the one output feed terminal to another one of the at least two input feed terminals.

13. The antenna according to claim 12, wherein in the direction perpendicular to the plane of the first substrate, the phase-controlled electrode covers the transmission portion of the sub-microstrip lines.

14. The antenna according to claim 12, wherein each of the transmission portions comprises an effective segment extending along an initial alignment direction of the liquid crystal layer, at least one transmission portion of the transmission portions comprises a non-effective segment extending in a direction other than the initial alignment direction of the liquid crystal layer, and two effective segments of any two adjacent transmission portions of the transmission portions are connected by the non-effective segment of one of the at least one transmission portion.

15. The antenna according to claim 14, wherein the two effective segments of the transmission portions have an equal length.

16. The antenna according to claim 14, wherein at least one of the two effective segments has a length different from the remaining ones of the two effective segments.

17. The antenna according to claim 16, wherein an extending direction of at least one of the non-effective segments is not perpendicular to the initial alignment direction of the liquid crystal layer.

18. The antenna according to claim 17, wherein an extending direction of at least another one of the non-effective segments is perpendicular to the initial alignment direction of the liquid crystal layer.

* * * * *